US009565898B2

(12) United States Patent
Mahoney

(10) Patent No.: US 9,565,898 B2
(45) Date of Patent: Feb. 14, 2017

(54) FOOTWEAR INCLUDING A SUPPORT CAGE

(71) Applicant: Wolverine World Wide, Inc., Rockford, MI (US)

(72) Inventor: Christopher J. Mahoney, Concord, MA (US)

(73) Assignee: Wolverine Outdoors, Inc., Rockford, MI (US)

( * ) Notice: Subject to any disclaimer, the term of this patent is extended or adjusted under 35 U.S.C. 154(b) by 232 days.

(21) Appl. No.: 14/498,047

(22) Filed: Sep. 26, 2014

(65) Prior Publication Data

US 2016/0088901 A1 Mar. 31, 2016

(51) Int. Cl.

| | |
|---|---|
| ***A43C 11/00*** | (2006.01) |
| ***A43B 23/22*** | (2006.01) |
| ***A43B 7/14*** | (2006.01) |
| ***A43B 9/02*** | (2006.01) |
| ***A43B 23/02*** | (2006.01) |

(Continued)

(52) U.S. Cl.

CPC ..... *A43B 23/22* (2013.01); *A43B 7/1495* (2013.01); *A43B 9/02* (2013.01); *A43B 23/0235* (2013.01); *A43B 23/0295* (2013.01); *A43B 23/07* (2013.01); *A43C 1/00* (2013.01)

(58) Field of Classification Search

CPC ..... A43B 23/22; A43B 23/02; A43B 23/0235; A43B 23/0295; A43B 23/0245; A43B 23/026; A43B 3/06

USPC ..... 36/108, 50.1, 58.5, 71.5, 72

See application file for complete search history.

(56) References Cited

U.S. PATENT DOCUMENTS 2,147,197 A * 2/1939 Glidden ..... A43B 1/02 36/3 A
5,243,772 A * 9/1993 Francis ..... A43B 5/00 36/106

(Continued)

FOREIGN PATENT DOCUMENTS

CA 2847248 10/2011
CA 2847248 A1 10/2011

OTHER PUBLICATIONS

Nike Air Presto (2012).

(Continued)

*Primary Examiner* — Anna Kinsaul
*Assistant Examiner* — Carolyn W Davis
(74) *Attorney, Agent, or Firm* — Warner Norcross & Judd LLP

(57) ABSTRACT

An article of footwear including an upper having a sleeve and a support cage that is free floating relative to the sleeve so that the footwear can accommodate a plurality of foot shapes regardless of whether the foot shapes remain static or dynamically change during a gait cycle within the footwear. The sleeve can be included in a midfoot section extending from a medial side of the footwear, across the top of a wearer's forefoot, to a lateral side of the footwear. A toe section including a breathable material can be joined with and forward of the midfoot section. The support cage can be constructed from a laminate including at least two layers, such as a structural exterior layer, an intermediate elastic layer and/or a reinforcement interior layer, optionally all fused together, to provide the cage with multiple functional attributes, such as structural stability, elasticity and/or reinforcement.

20 Claims, 8 Drawing Sheets

(51) Int. Cl.
*A43B 23/07* (2006.01)
*A43C 1/00* (2006.01)

(56) References Cited

U.S. PATENT DOCUMENTS 5,377,430 A * 1/1995 Hatfield ..... A43B 3/08 24/714.6
D362,335 S 9/1995 Estefano
D377,414 S 1/1997 Hatfield
5,678,329 A * 10/1997 Griffin ..... A43B 5/00 36/114
7,347,012 B2 * 3/2008 Clark ..... A43B 1/14 36/50.1
7,500,323 B2 * 3/2009 Rasmussen ..... A43B 1/0081 36/50.1
D593,306 S 6/2009 St-Louis et al.
D600,896 S * 9/2009 St-Louis ..... D2/969
D600,898 S * 9/2009 St-Louis ..... D2/969
D600,900 S * 9/2009 St-Louis ..... D2/969
D605,843 S * 12/2009 Andersen ..... D2/969
7,757,412 B2 * 7/2010 Farys ..... A43B 5/0439 36/50.1
7,784,198 B2 * 8/2010 Roudebush ..... A43B 3/101 36/112
7,793,435 B1 * 9/2010 Ruth ..... A43B 5/00 36/50.1
D646,471 S 10/2011 Mahoney
D651,787 S 1/2012 Mahoney
D659,976 S 5/2012 Mahoney
D662,695 S 7/2012 McVicker et al.
D668,437 S 10/2012 Mahoney
D671,718 S 12/2012 McVicker et al.
8,479,415 B2 * 7/2013 Berger ..... A43B 3/24 36/100
8,595,957 B2 * 12/2013 McDowell ..... A43B 7/085 36/45
D711,088 S 8/2014 Kirschner
D732,268 S 6/2015 Grenet et al.
D737,040 S 8/2015 Pauk
D752,850 S * 4/2016 Mahoney ..... D2/969
2002/0007570 A1 * 1/2002 Girard ..... A43C 1/00 36/88
2007/0294920 A1 * 12/2007 Baychar ..... A43B 3/0084 36/113
2010/0083535 A1 * 4/2010 Meschter ..... A43B 7/1495 36/88
2011/0107621 A1 * 5/2011 Mordecai ..... A43B 3/02 36/113
2011/0162239 A1 * 7/2011 Bier ..... A43B 1/04 36/3 B
2011/0197475 A1 * 8/2011 Weidl ..... A43B 1/0009 36/107
2011/0308115 A1 * 12/2011 Le ..... A43B 7/1495 36/9 R
2012/0011744 A1 * 1/2012 Bell ..... A43B 1/0072 36/91
2012/0079741 A1 * 4/2012 Kohatsu ..... A43B 3/26 36/50.1
2013/0104423 A1 * 5/2013 Hatfield ..... A43B 5/001 36/103
2013/0219752 A1 * 8/2013 Dombrow ..... A43B 23/0295 36/102
2014/0237858 A1 * 8/2014 Adami ..... A43B 23/0205 36/107
2015/0013187 A1 * 1/2015 Taniguchi ..... A43B 1/04 36/84
2015/0342261 A1 * 12/2015 Boucher ..... A43B 1/04 36/84

OTHER PUBLICATIONS

Nike Vapor Tour (2012).
Nike Reax TR 8 (2012).
Salomon Speedcross 3 (2012).

* cited by examiner

FOOTWEAR INCLUDING A SUPPORT CAGE

BACKGROUND OF THE INVENTION

The present invention relates to footwear, and more particularly to a footwear construction including a support cage and a sleeve.

Footwear comes in many sizes and shapes to fit the many sizes and shapes of different wearers' feet. While theoretically there may be an "average" foot shape, in reality, there is not one because every foot has a unique shape. Footwear manufacturers usually address this as best they can by having a variety of different sizes and widths of certain footwear models, with the hope of coming close to fitting the feet of most potential purchasers. Many such footwear, however, are constructed with multiple overlays or panels that are stitched together. These overlays, and the resultant footwear, are frequently difficult to shape to the large variety of compound curves and contours of certain feet, let alone many differently shaped feet.

Another challenge to making well-fitting footwear is due to the fact that every foot, of every shape and size, changes its shape during a wearer's stride. For example, a foot can be elongated and narrow, or "stretched out", right before heel strike during a normal gait. Upon heel strike, the arch of the foot may "contract" slightly to shorten the length of the foot slightly. When the foot starts to roll forward on the ball of the foot, the forefoot typically widens, and then narrows again during toe off. During this movement, the foot of the wearer changes in shape. If a shoe is inelastic, then the changing shape of the foot will not match the unitary shape of the interior of the footwear throughout the gait cycle. This can cause irritation, discomfort and in some cases can detrimentally alter the wearer's gait.

Some footwear manufacturers have attempted to address the above issues by utilizing a very pliable, elastic material to construct the upper of the footwear. Certain manufacturers have produced an upper constructed simply with a knitted sock of varying textures, closed it with laces, and attached it to an outsole. Although this construction is flexible and conformable to a variety of foot sizes and shapes, because the sock readily deforms, it might not provide satisfactory stability or structural support to the wearer's foot.

Thus, there remains room for improvement in the area of producing footwear that fits multiple foot shapes and dynamically conforms to a wearer's moving foot.

SUMMARY OF THE INVENTION

A footwear construction including a support cage and a sleeve are provided to accommodate a variety of foot shapes and to adapt to changes in foot shape during a normal gait cycle, all while providing satisfactory stability and support.

In one embodiment, the support cage is at least partially free floating over a portion of the sleeve. The support cage optionally can be selectively and fixedly attached to the sleeve or other parts of the upper, above an outsole.

In another embodiment, the sleeve includes a midfoot section forming an arch and/or central portion that extends across the top of the wearer's foot when the foot is positioned in the footwear. With this midfoot section, the footwear can be void of a separate tongue. The midfoot section can include a medial side panel, a lateral side panel and a central panel that connects the side panels. The medial and lateral side panels can be more flexible and/or elastic than the central panel.

In still another embodiment, the midfoot section can include a front edge and a rear edge. The front edge can be joined with a toe section that extends forwardly of the midfoot section over the toes of a wearer. This toe section can be constructed from a panel separate from the panels of the midfoot section. Optionally, the toe section can be constructed from a breathable, air permeable material to facilitate air flow through the toe section to a wearer's foot.

In yet another embodiment, the midfoot section rear edge can be joined with a heel section that extends rearwardly of the midfoot section around the heel of a wearer. This heel section can be constructed from another panel separate from the panels of the midfoot section. The heel section also can include a heel support frame, optionally externally mounted relative to the footwear. The heel section can be constructed from a more rigid and structurally reinforced set of materials to provide support and stability to the heel.

In even another embodiment, the support cage includes at least one heel counter band that extends rearwardly from the midfoot section and at least partially around the heel section.

In a further embodiment, the support cage can be constructed from multiple layers of different materials to form a laminate. For example, the support cage can include an outer or exterior layer of a polymeric film and an inner or interior layer of a reinforcing material. This interior layer can be on the interior of the support cage, facing an exterior of the sleeve. Optionally, an elastic intermediate layer of knitted material can be disposed between the outer layer and the inner layer to provide a desired amount of stretch and rebound to the support cage.

In still a further embodiment, the inner, outer and optionally intermediate layers can be fused together. As an example, the layers can be hot melted, sonic welded, radio frequency welded and the like.

The current embodiments provide footwear that can accommodate more foot shapes and that can adapt to changes in foot shape during the natural gait cycle. The support cage and sleeve float relative to one another, allowing their dynamic conformance and reconfiguration to multiple foot contours and shapes, even during the gait cycle. Where the support cage includes the laminate construction, the support cage can exhibit multiple characteristics, for example, structural rigidity and stability provided by the outer layer film, stretchability and recovery of the intermediate layer, and the reinforcement of the inner layer. The sleeve also can be joined with other footwear components, such as the heel section and the toe section, to enable those sections to be dedicated to other functions, for example heel stability and air circulation in the forefoot, respectively.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
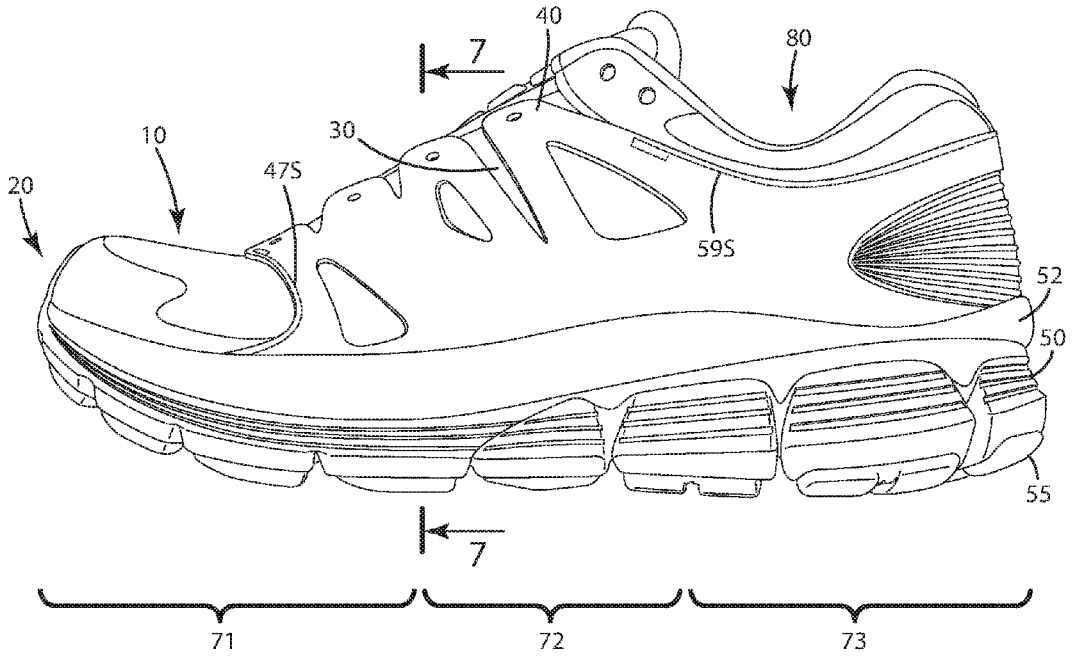
FIG. 1 is a side view of footwear including a support cage and sleeve in accordance with a current embodiment.
Figure 2:
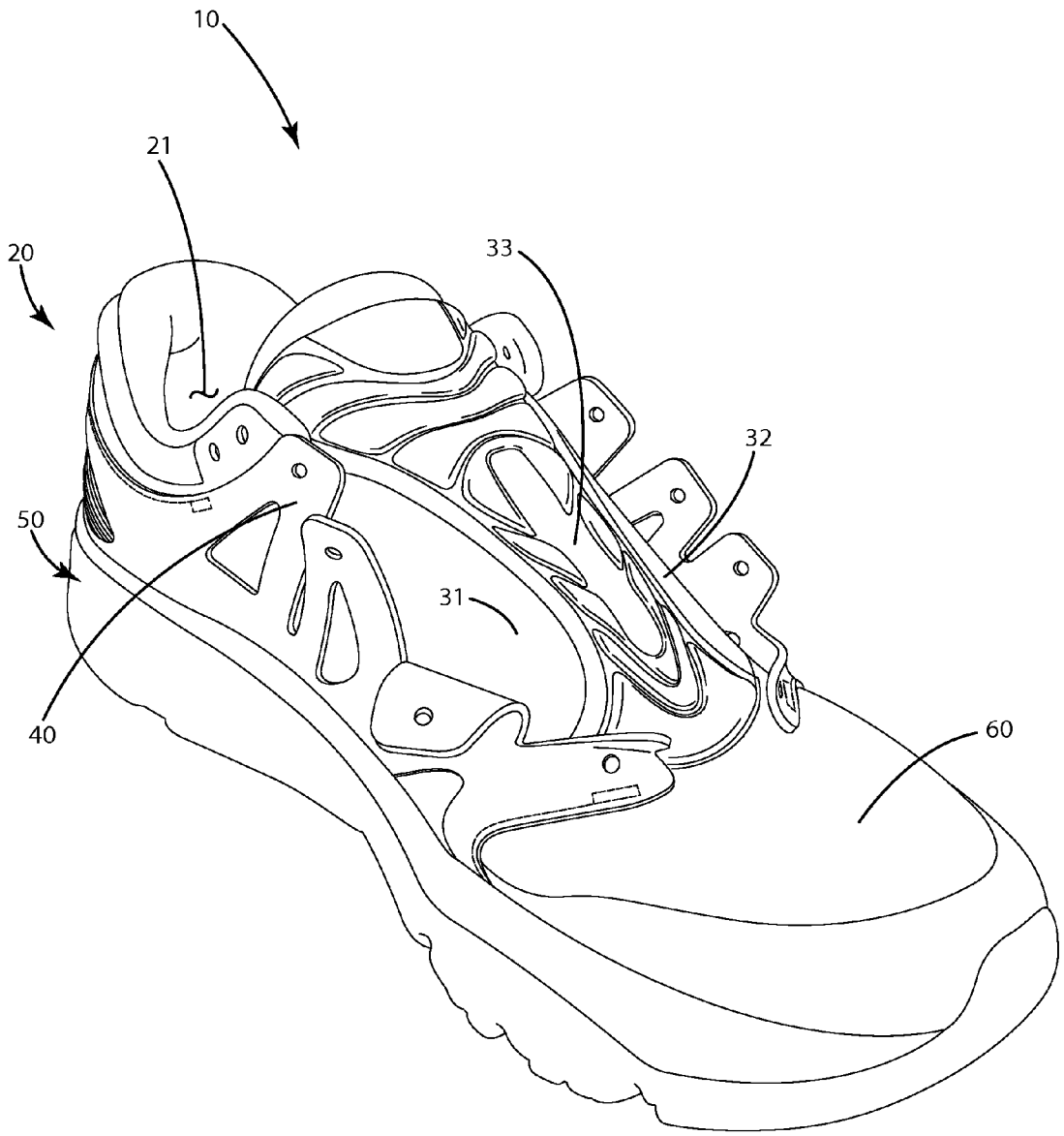
FIG. 2 is an upper perspective view of the footwear.

An article of footwear in accordance with a current embodiment is shown in FIGS. 1-19 and generally designated 10. The footwear includes an upper assembly 20 having a sleeve 30 over which a support cage 40 is at least partially free floated. The upper is joined with a sole assembly 50 having a midsole 52 and outsole 55. The upper assembly 20 optionally is of a Strobel construction in which the foot-receiving upper interior 21 is closed on its bottom or lowermost portion by a Strobel board, an insole board, sock or liner 22 or other similar component. Although not shown, the footwear 10 can include a footbed and/or other upper components with the footbed fitted into the upper 10.

Figure 3:
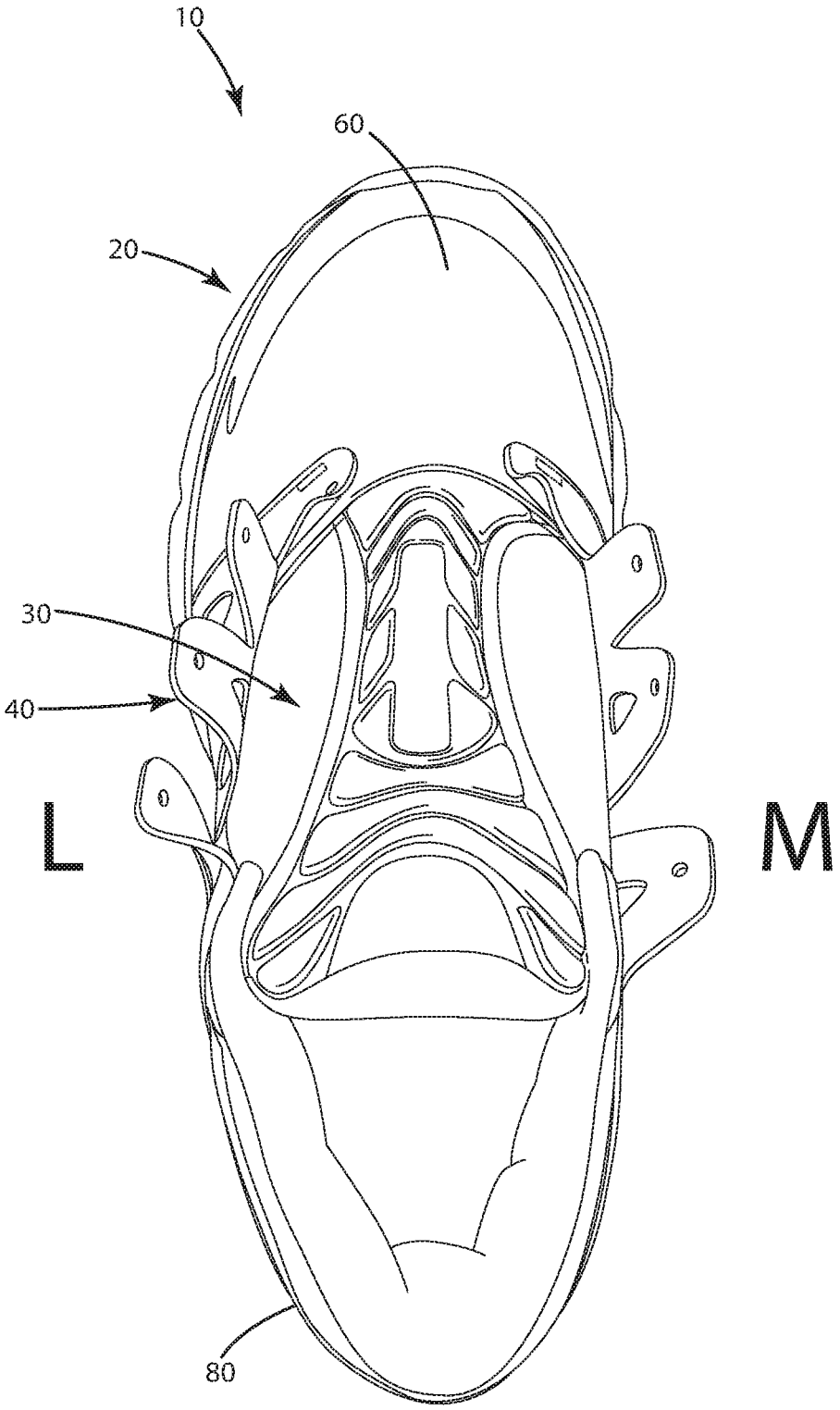
FIG. 3 is an upper view of the footwear.
Figure 6:
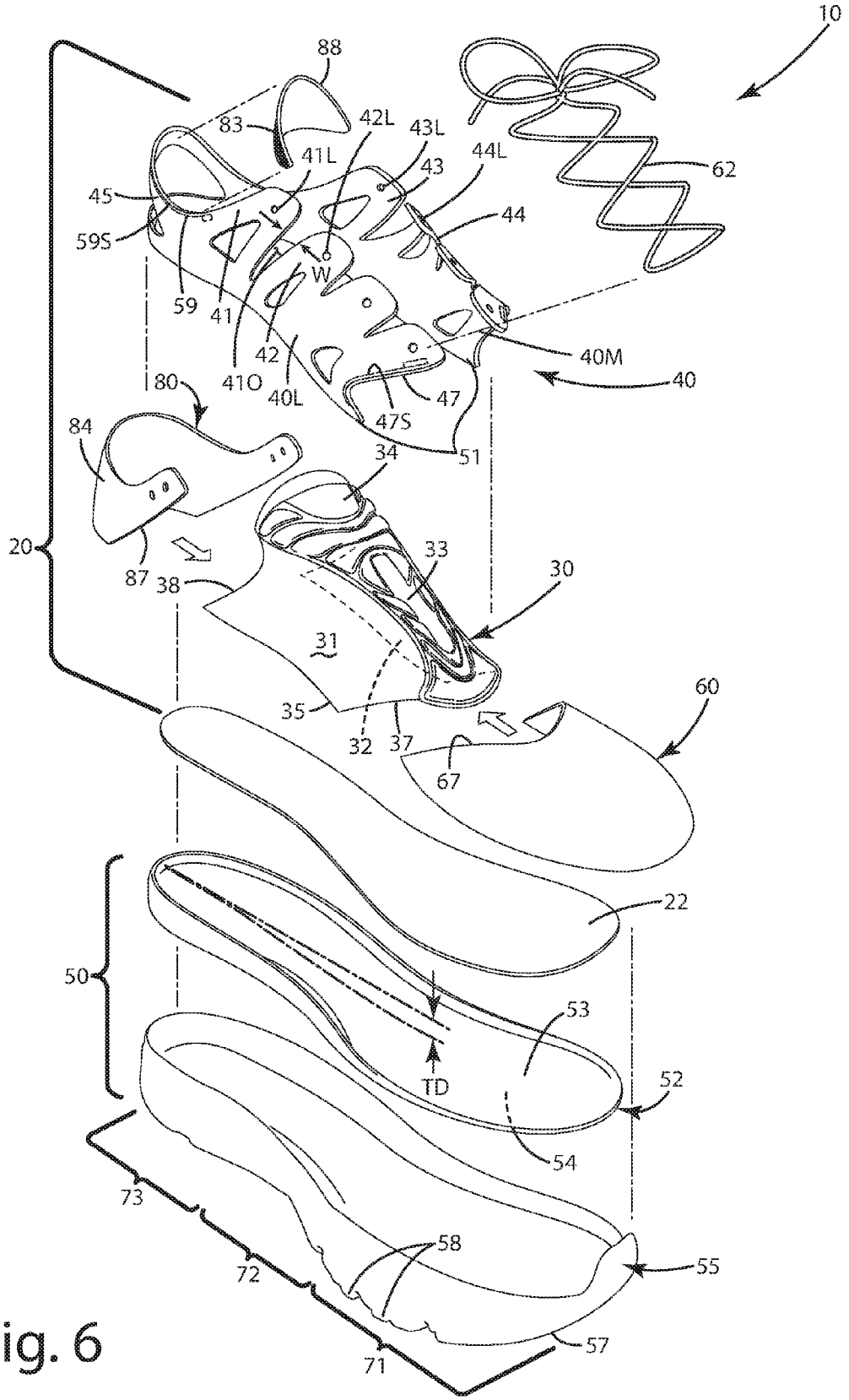
FIG. 6 is an exploded view of the footwear including the sleeve and support cage.
Figure 9:
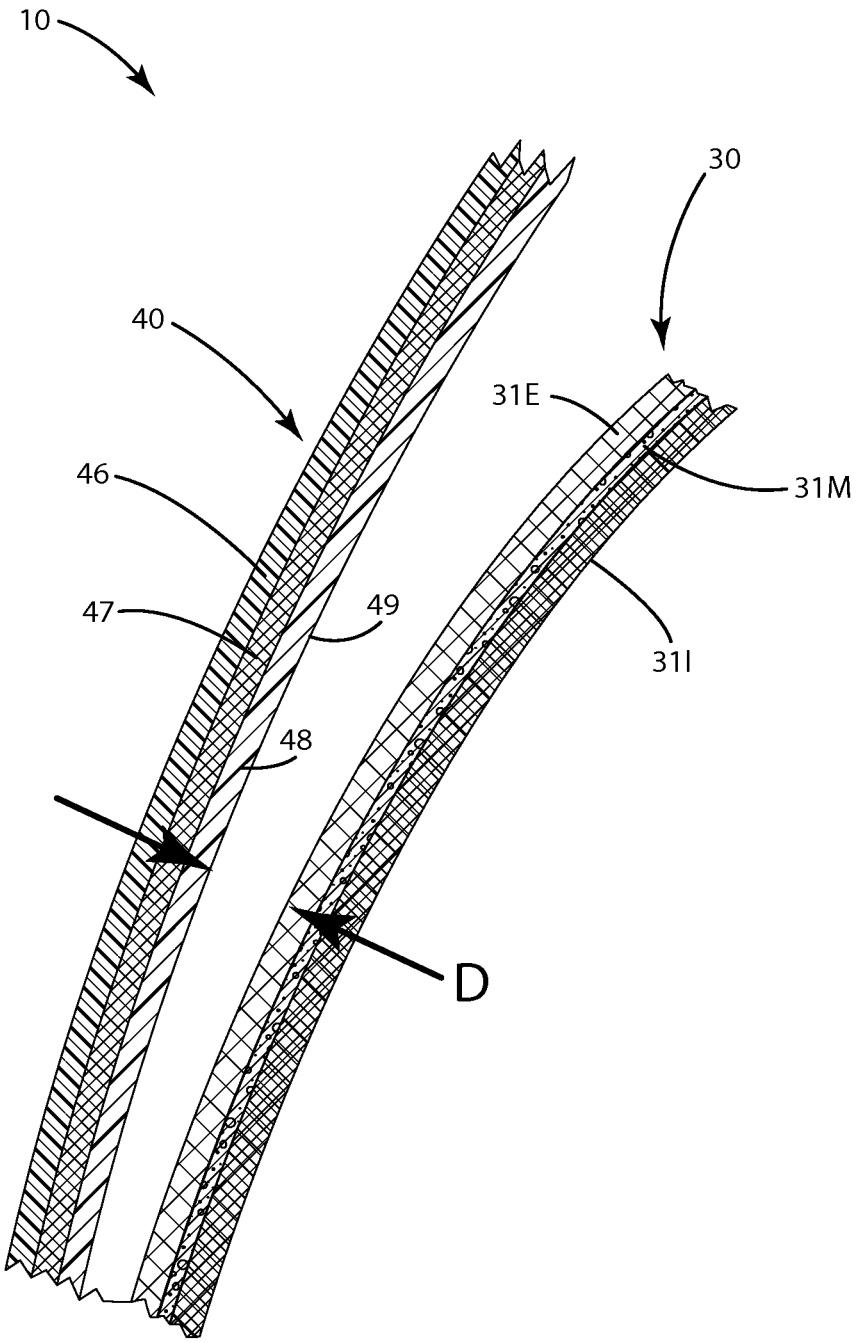
FIG. 9 is a section view of the support cage illustrating an optional laminate construction.

As illustrated in FIGS. 1, 3 and 6, the upper includes a support cage 40, a sleeve 30 over which the support cage 40 at least partially or fully free floats; and an optional midsole 52 and outsole 55 which collectively form a sole assembly 50. As shown in FIG. 9, the support cage 40 can be a laminate construction including multiple first 46, second 47 and third 48 layers. Of course, one of these layers could be eliminated and additional layers can be added depending on the particular application. The first layer 46 can be an exterior stability and/or support layer. The second layer 47 can be an elastic intermediate layer adapted to provide elasticity to the support and recovery to the support cage. The third layer 48 can be a reinforcement layer, constructed to reinforce the elastic intermediate layer 47 and provide an interior surface 49 adapted to engage the sleeve 30 and free float relative thereto.

Optionally, the laminate of the support cage 40 can be disposed a preselected distance D from the exterior surface of the sleeve 30. This distance can be about 0.01 mm to about 1 mm, or other distances depending on the particular application and the tightness of the support cage 40 as it is secured over the sleeve 30 when a wearer dons the footwear 10. This distance also can vary along the length of a support cage extending generally from the sole assembly toward the laces 62, which can be laced through certain portions of the support cage 40 as described in further detail below.

Either optionally, the sleeve 30 can be constructed to include a lateral side panel 31, a medial side panel 32 and central panel 33 that are joined with one another. Optionally, these panels can be joined in such a manner such that they form a continuous arch without any gaps or openings, the arch extending from the sole assembly 50 on a lateral side L of the footwear to a medial side M of the footwear. As illustrated, the footwear also can define a longitudinal axis LA. This longitudinal axis generally separates the footwear into the lateral side L and the medial side M, which are generally disposed across one another across the longitudinal axis.

The sole assembly 50 also can include a heel-to-toe drop differential of optionally about 4.0 mm to about 12.0 mm, further optionally, about 8.0 mm as shown in FIG. 6. That heel-to-toe drop can be the difference in elevation TD between the upper surface of the midsole in the heel region and the upper surface in the toe region.

Although the current embodiments are illustrated in the context of an athletic or running shoe, they may be incorporated into any type or style of footwear, including performance shoes, hiking shoes, trail shoes and boots, hiking boots, all-terrain shoes, barefoot running shoes, sneakers, conventional tennis shoes, walking shoes, multisport footwear, casual shoes, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation.

Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot 71, arch or midfoot 72 and heel 73 region are generally identified in FIG. 1, however, it is to be understood that delineation of these regions may vary depending upon the configuration of the sole assembly and footwear.

For purposes of disclosure, the embodiments herein are described in connection with footwear in the form of a running shoe 10 having an upper assembly 20, which as mentioned above, optionally can include a Strobel construction. Of course, the sole assembly 20 herein can be combined with any other type or style of upper construction capable of being suitably joined with the sole assembly 50.

The joining of the sole assembly and the upper assembly can be accomplished using adhesives, cement, injection molding, pour molding or any other technique used to join an upper and sole. As illustrated, the insole board or liner 22 can rest or be placed immediately adjacent the midsole upper surface 53 if optionally included in the construction.

With reference to FIGS. 1 and 6, the sole assembly 50 can be of a two-piece construction as mentioned above, generally including the midsole 52 and outsole 55. The midsole 52 can be constructed from a material having a first density that is generally less dense than the density of the material from which the outsole 55 is constructed. The first density can optionally be about 1 pound per cubic foot to about 20 pounds per cubic foot, and further optionally about 2 pounds per cubic foot to about 12 pounds per cubic foot, or other densities depending on the application. Generally the first density of the midsole is such that it compresses relatively easily to provide cushion to the wearer's foot. The midsole material also can have a first durometer, optionally about 35 Asker C to about 55 Asker C, further optionally about 42 Asker C to about 48 Asker C, and even further optionally about 45 Asker C or about 43 Asker C. The midsole can be constructed from ethyl vinyl acetate (EVA), polyurethane, latex, foam, a gel or other materials.

The midsole 52 can include an upper surface 53 and an opposing lower surface 54. Generally, the upper surface 53 can be joined with the bottom of the upper assembly 20 for example, the board 22, support cage 40 and/or sleeve 30. The upper surface 53 can be contoured to closely follow the natural contours of the bottom of a wearer's foot. For example, in the heel region 73, the midsole 52 can include a heel cup that generally extends around and receives a wearer's heel therein when the footwear is worn by a wearer. The heel cup can offer some reinforcing support to the upper in the heel region, and generally prevent lateral or medial rolling of the heel.

The outsole 55 can be disposed below the midsole 52 and the upper assembly 20. The outsole 55 can be constructed from one or more materials, and the current embodiment can be constructed from foam and a rubber bottom 57 in the form of lugs, tread, or other gripping elements 58. Alternatively, it can be constructed from a thermoplastic polyurethane elastomer (TPU), nylon or other polymer blend that includes nylon and/or TPU. Of course, the outsole can be constructed from any relatively wear resistant polymer, elastomer and/or natural or synthetic rubber or other materials capable of providing the desired functional characteristics. The outsole also can be constructed to include thermoplastic elastomers and/or thermalset elastomers. Other materials such as fiber-reinforced polymers can be used. These can include epoxy, polyethylene, polyester, thermosetting plastic reinforced with carbon, glass and/or aramid fibers.

Figure 7:
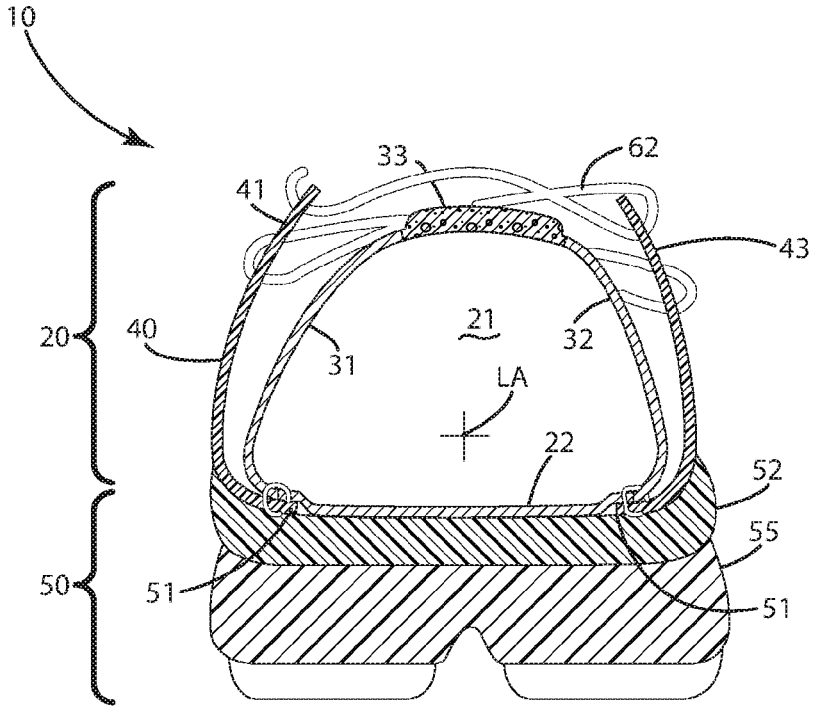
FIG. 7 is a section view of the footwear taken along line 7-7 of FIG. 1.
Figure 8:
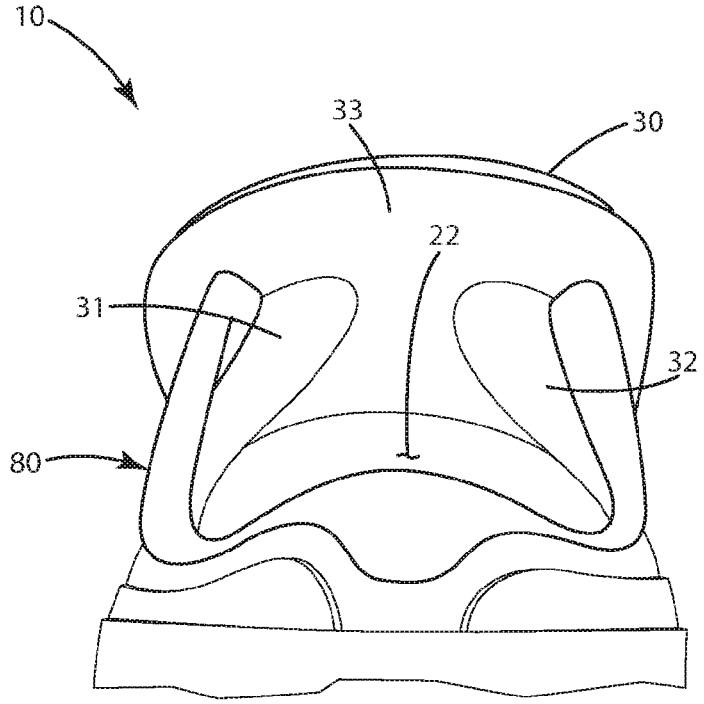
FIG. 8 is a perspective view of the inside of the footwear, and in particular, the sleeve, as seen through the ankle opening of the footwear.

As shown in FIG. 7, the midsole 52 and/or generally the sole assembly 50 can be adhesively joined with other otherwise molded upon the lower peripheral allowances 51 of the support cage 40 and/or the bottom of the insole board 22 associated with the sleeve, toe and/or heel sections where included.

As shown in FIGS. 2-4 and 6, the upper assembly 20 can include a sleeve 30 as mentioned above. The sleeve can include multiple panels 31, 32 and 33 which are joined together to form a generally continuous arch across the top of the wearer's foot, optionally above the tops of the metatarsals. In this construction, the sleeve can generally take the place of a separate tongue. The sleeve panels 31, 32 and 33 can be formed to impart different characteristics to each of them and thus the sleeve. For example, the side panels 31 and 32 can be constructed from a generally elastic and stretchable material such as Lycra or Spandex. This structure can include an interior layer 311 and an exterior layer 31E, as shown in FIG. 9. The interior layer 311 can generally face the interior 21 of the upper. In some cases this interior layer 311 directly contacts the wearer's foot and/or a sock worn by the wearer. This layer can be generally smooth and nonabrasive to the wearer's skin. The exterior 31E can be constructed from an open mesh material having openings about 0.1 mm to about 3 mm, further optionally about 0.5 mm to about 1 mm. Optionally, the mesh can be formed from a nylon or other braided material and be generally slippery or low friction. This can enable the interior surface 49 of the support cage 40 to move freely and float relative to the exterior layer 31E. Optionally, the sleeve and/or panels can include an intermediate or middle layer 31M. This middle layer 31M can be in the form of an open or closed cell form. Optionally, it can be visible through the outer exterior layer 31E, particularly when that layer is constructed from an open mesh. The foam can provide resilience and cushion between the exterior layer 31E and the interior layer 311 of the sleeve 30.

This layered construction can be utilized in the lateral and medial panels, and optionally the central portion. In the embodiment as illustrated, the central portion 33, however, can be constructed from a contoured structure that generally is less pliable and less elastic than the side panels. For example, the central portion 33 can be constructed from a foam that is encased within a woven or knitted fabric construction. The central portion can be less stretchable and/or pliable than the respective side panels. The central portion also can include more cushioning in the form of additional foam or other material disposed therein. This cushioning can alleviate any extra stresses exerted across the top of the wearer's foot when the laces 62 are installed and extend over the central portion 33 of the sleeve 30. Optionally, the sleeve 30 can include a flap 34 that extends rearwardly from the central portion 33. This flap can be adapted to engage the forward portion of the wearer's ankle to prevent abrasion and generally provide increased cushion in that location.

As illustrated in FIG. 6, the sleeve 30 can include a lower peripheral allowance 35. This lower peripheral allowance 35 can be Strobel stitched to an insole board or otherwise attached to an insole board 22 in the final construction.

As shown in FIGS. 1 and 6, the upper assembly 20 can include a toe section 60 and a heel section 80 that are separately constructed, but joined with the sleeve 30. The toe section 60 can cover the toes and the forward portions of the phalanges of the wearer's foot. The toe section 60 can include a bumper to prevent tearing or scuffing of the material from which the toe section 60 is constructed. Optionally, the toe section 60 can be constructed from a breathable material, such as an open, specially knitted mesh that provides air circulation directly to the wearer's toes and forefoot. This construction can provide enhanced cooling to the foot. The toe section 60 can be stitched to a forward edge 37 of the sleeve 30. This forward edge can be coextensive with the lateral 31 and medial side panels 32 as well as the central panel 33. The rear edge 67 of the toe section 60 can be stitched, cemented, fastened or otherwise secured to the front edge 37 of the sleeve 30. This attachment can ensure the toe section is fixedly and immovably joined with the sleeve 30 at this location.

Figure 5:
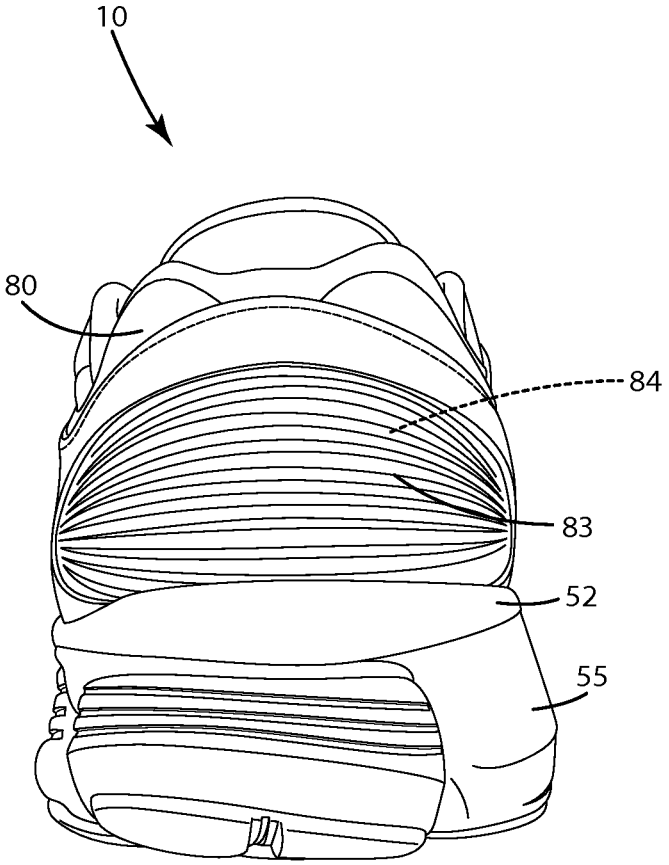
FIG. 5 is an rear view of the footwear showing a heel support frame.

As shown in FIGS. 5 and 6, a heel section 80 can be joined with the sleeve 30. In particular, the forward edge 87 of the heel section 80 can be stitched, cemented, fastened or otherwise joined with the rear edge 38 of the sleeve 30. This attachment can ensure the heel section is fixedly and immovably joined with the sleeve 30 at this location.

The heel section 80 can include a heel support frame 83. The heel support frame 83 can be constructed from a rigid, polymeric material such as thermoplastic material, polyvinyl materials or other materials. Optionally, the support frame 83 can be translucent and/or transparent so that an observer of the heel can view an underlying material 84 through the support frame 83. The material 84 can be in the form of a breathable material or can aesthetically match the material in the toe section 60. Of course other materials can be utilized. The heel support frame can be constructed to provide stability to the heel.

The heel section 80 can include additional cushioning and/or padding to pad the region of the footwear in the heel that repeatedly and forcibly engages the back of the heel of the wearer. Additional liners or other material can be disposed on the interior of the footwear in the heel section, depending on the particular application.

The support cage 40 can extend in the form of a heel counter band 45 adjacent the heel section 80. This heel band can extend around at least a portion of the wearer's heel and can be in the form of a strip. The strip can be disposed adjacent a perimeter 88 of the heel support frame. Optionally, the heel band 45 can conceal or otherwise obscure the perimeter 88 of the heel support frame 83. The heel band can be constructed to cooperatively to provide stability and structural support around and to the heel of a wearer. The support cage, the heel band and/or heel support frame 83 can cooperate with the heel cup of the midsole 52 to provide additional stability, centering and support for the heel of a wearer.

The footwear 10 can include a support cage 40 which is illustrated in FIGS. 2, 4, 6 and 7. As shown there, the support cage 40 is constructed to include a medial side 40M and a lateral side 40L. These sides can be connected rearward, around the heel region, optionally by the heel band 45. Of course if desired, the heel band 45 can be absent from the construction, with the support cage 40 being primarily formed by the lateral 40L and medial 40M sides. The lateral and medial sides also can include a peripheral allowance 51. This peripheral allowance 51 can be stitched, cemented or otherwise fastened to the sleeve 30 and/or board 22. Alternatively, the peripheral allowances 51 can extend under the foot of the wearer and can be connected so that the lateral 40L and medial sides 40M are attached along a seam located under the wearer's foot when the footwear is donned. Even with the peripheral allowance 51 attached to the lower peripheral allowance 35 of the sleeve, the cage and the sleeve are considered substantially free floating relative to one another.

The lateral and medial sides 40L and 40M can respectively include a plurality of upright elements 41, 42, 43 and 44. The first upright element 41 is separated from the second upright element 42 by at least one open space 41O. The other upright elements can be separated from one another by similar open spaces as well. The open space 41O can enable at least a portion of the first upright element 41 to move independently and relative to another portion of the second upright element 42. For example, upon midfoot landing and subsequent toe off, the shape of a foot within the upper, and in particular the sleeve 30, changes. Upon this change, the upright elements 41 and 42, which can be attached via a lace 62 to the opposing upright elements 43 and 44, begin to pull and move toward one another so that the open space 41O decreases in width W. This decrease in width allows the support cage to provide structural stability to the midfoot yet still conform to the dynamically changing shape of the wearer's foot disposed within the footwear. The other open spaces 41O in other regions between different upright elements also can change in width or spacing to provide the same effect.

Figure 4:
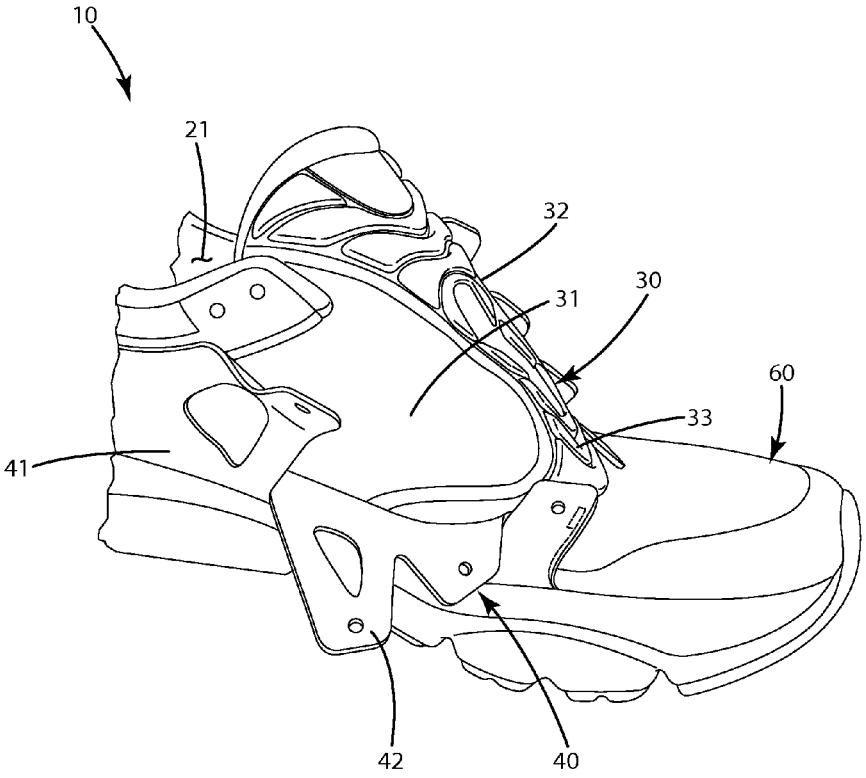
FIG. 4 is a side view of the footwear with a portion of the support cage pulled down and away from the sleeve.

As mentioned above, the support cage 40 can be separately constructed from the sleeve, and optionally not attached to the sleeve, optionally forming a small space therebetween when the footwear is not on a wearer's foot (FIG. 7). The support cage can be pulled away from the sleeve 30 as shown in FIG. 4 when the laces are removed from the construction. As illustrated there, the interface and attachment of the toe section 60 to the sleeve 30 also can be concealed by a portion of the support cage 40 for example the upright elements thereof. Thus, the toe section can extend under at least a portion of the support cage. The sleeve 30 can be disposed under at least a portion of the support cage. The support cage, however, is free floating and not directly attached to the side panels 31 and 32 of the sleeve 30. This is why the upright elements 41 and 42 for example can be pulled outward and away from the side panel 31. Again, with this free floating construction between the support cage and the sleeve, the foot can be comfortably placed within the footwear, while the sleeve can move dynamically relative to the support cage to accommodate different foot sizes and shapes, as well as accommodate the changing shape of a foot during a dynamic activity such as a natural gait cycle. Generally, the support cage is free floating relative to the midfoot section and/or sleeve 30 so that an interior surface 49 of the support cage can engage or move relative to an exterior layer or surface 31E of a medial panel and/or lateral panel so that footwear can accommodate multiple foot shapes therein.

As shown in FIG. 6, the first upright element 41 and second upright element 42 are disposed on the lateral side 40L. The first upright element and the second upright element can each include lace attachment elements 41L and 42L. The lace attachment element 41L can be a first attachment element and the second lace attachment element 42L can be second lace attachment element. These elements can be in the form of grommets, rings or holes disposed or defined by the upright elements or attached to the upright elements depending on the particular application. The opposing upright elements 43 and 44 on the medial side 40M can include a third and fourth lace attachment elements 43L and 44L. A lace can be joined with the first, second, third, fourth lace attachment elements and can extend back and forth across the central panel 33 or generally across the upper portion of the wearer's foot. The lace can be tightened to keep the footwear on the wearer's feet and to complete the construction connecting the lateral and medial sides of the support cage to provide the desired structural support.

As shown in FIGS. 1, 4 and 6, the support cage includes a forward front edge 47 and a rear edge 59. The front edge 47 can be associated with a forward most upright element of the support cage. The forward edge 47 also can be fixedly and immovably secured to the toe section 60 of the footwear. This can be accomplished via stitching 47S which is stitched through the support cage and into the toe section. Of course the stitching 47S can be replaced with cement, adhesives or other fasteners. The rear edge 59 of the support cage 40 can be disposed adjacent the rearmost upright elements 41 and 43. The edge can generally be disposed under the ankle opening of the footwear. The rear edge 59 can be stitched with stitching 59S to secure it to the heel section 80. The rear edge 59 can transition to the heel band 45 which again extends around the rearward portion of a heel of the wearer. Optionally, the stitching can be replaced with cement, adhesives or other fasteners to join these elements. Generally, the support cage is fixedly and immovably attached to the respective toe section and heel sections, but free floats relative to the sleeve 30.

As shown in FIG. 9, the support cage can be constructed from multiple layers to form a laminate. Each of the layers can be separately and independently constructed before being assembled to form the laminate. As an example, the exterior layer 46 can be in the form of a polymeric film. This polymeric film can be in the form of polyurethane, or thermoplastic elastomers such as copolyester, polyolefin, polyethylene or like materials. This polymeric film exterior layer can be configured to provide support and stability to the support cage and thus the wearer's foot during a natural gait cycle. The material is also not too rigid, and instead flexible, and in some cases slightly elastic, so that the exterior layer can stretch slightly. The exterior layer optionally can be about 0.1 mm to about 0.75 mm in thickness depending on the particular application.

The laminate also can include an interior layer 48. This interior layer can generally be constructed from a reinforcing material. As an example, the interior layer can be a reinforcement interior layer constructed from a woven or knitted material, such as polyester. This can be provided to enhance the support capabilities of the support cage. Other materials suitable for use as the reinforcement interior layer can include non-wovens and polymeric films. Optionally, between the interior layer and the exterior layer 46 and 48, an intermediate layer 47 can be disposed. The intermediate layer can be constructed from an elastic material constructed, for example, from elastic fibers and/or elastic filaments. Optionally, the intermediate layer can be constructed from Lycra or Spandex which includes the following mixture of materials in their respective percentages: 1-25% Lycra or Spandex with the balance being polyester, nylon, rayon, cotton, or like materials.

The respective layers of the laminate, for example, the interior, exterior and intermediate layers can be separately formed. These layers can then be placed over one another and fused together to form a single multi-layered laminate material that is unable to be disassembled into its respective layers without destroying the laminate. The different layers can be fused together using heat, applied for example, through sonic welding, radio frequency welding, hot melting and other forms of heat welding. With the fusing of the different layers, the layers tend to bond chemically and physically to one another so that they cannot be easily separated. In turn, this provides the support cage with a unitary laminate structure that provides both structural stability and strength via the exterior layer, elasticity, stretch and rebound via the intermediate layer, and reinforcement of the intermediate layer via the interior layer. Of course the different layers can be intermixed and matched depending on the particular application. Indeed, the intermediate and interior layer could potentially be replaced with a single material that is capable of providing an elasticity yet is still strong enough to resist degradation over repeated use.

A method of making the footwear 10 will now be described with further reference to FIGS. 6-9. To construct the footwear 10, the sole assembly 50 can be molded in a mold. As an example, midsole 52 and the outsole 55 can be separately molded in respective first and second molds. These elements can then be joined with one another via adhesive or cement. Alternatively, they can be molded together simultaneously. The respective heel-to-toe drop TD can be incorporated into the midsole or sole assembly in general in this formation process.

The sleeve 30 can be assembled. In particular, the central portion 33 can be stitched or otherwise joined with the respective lateral and medial panels 31 and 32. The central panel can be cut to define the flap 34. This sleeve can be constructed from the materials as described above. The toe section 60 can be separately assembled and formed from a different material. This toe section 60 can be joined with the sleeve 30 via attaching the forward edge 37 of the sleeve to the rearward edge 67 of the toe section. The heel section 80 can also be independently constructed. For example, the heel support frame 83 can be disposed over the material 84. This heel section then can be secured to the rear edge 38 of the sleeve. Optionally, the forward edge 87 of the heel section can be stitched to the rearward edge 38 of the sleeve. To the bottom of the heel section, toe section and sleeve 30, the insole board can be joined, optionally joining with the peripheral allowances of these structures to form a Strobel construction.

The support cage 40 can be formed by first forming laminate structure of the cage. The exterior layer 46 constructed from a polymeric material such as a polymeric film can be formed as a flat sheet. The intermediate layer 47 can be placed atop that exterior layer 46 and the interior layer 48 can be placed atop the intermediate layer 47. These components can be placed in a die. The die can be heated so that the respective different layers fuse together to form a unitary construction and laminate. This laminate can then be die-cut into the support cage form shown in the figures to include the upright elements, the heel band and respective edges.

The support cage can be placed around the sleeve and heel section and optionally over a portion of the toe section with the upright elements pointing generally upright. The forward edge 47 and rearward edge 48 of the support cage can be secured to the respective toe section and heel section as desired. With these components so constructed, the support cage can be wrapped under at least a portion of the insole board 22 so that the peripheral allowance 51 extends below that insole board. With the upper assembly 20 complete, the sole assembly 50 can be joined via adhering, cementing or otherwise fastening the sole assembly thereto. Of course if desired, the upper assembly can be placed on a last, and the respective components of the sole assembly can be molded directly in place over the insole board 22 and the lower peripheral allowances of the respective other upper components. After the sole assembly and upper assembly are joined, the footwear can undergo additional finishing operations to brush, cleanup and touchup the footwear for further packing or distribution.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual elements of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An article of footwear comprising:

an upper comprising:

a midfoot section including a lateral panel disposed on a lateral side of the footwear, a medial panel disposed on a medial side of the footwear, and a central panel configured to span across the top of a wearer's forefoot, joining the lateral panel and the medial panel to form a sleeve adapted to extend at least partially around a wearer's foot, the lateral and medial panels including a first material;

a toe section joined with and forward of the midfoot section, the toe section including a breathable second material different from the first material;

a heel section joined with and rearward of the midfoot section, the toe and heel sections separately and independently constructed relative to the midfoot section, but joined with the midfoot section;

a support cage constructed from a plurality of layers including an exterior layer and an interior layer joined with one another to form a laminate, the laminate adapted to provide structural stability and reinforcement to the support cage, the support cage including a plurality of lateral upright elements extending upwardly adjacent the lateral panel and a plurality of medial upright elements extending upwardly adjacent the medial panel without crossing over the central panel of the midfoot section; and an outsole joined with the upper, wherein the support cage is free floating relative to the midfoot section so that the lateral and medial upright elements of the support cage engage but move relative to the lateral and medial panels, respectively, whereby the footwear can accommodate a plurality of foot shapes regardless of whether the foot shapes remain static or dynamically change during a gait cycle, wherein the support cage includes a first lower peripheral allowance, wherein an insole board is stitched to the first lower peripheral allowance to close a bottom of the support cage.

2. The article of footwear of claim 1, wherein the laminate exterior layer includes a polymeric film, wherein the interior layer is a reinforcement layer.

3. The article of footwear of claim 2, wherein the laminate includes an elastic intermediate layer disposed between the interior layer and the exterior layer, wherein the polymeric film, elastic intermediate layer and reinforcement interior layer are fused together to form the laminate.

4. The article of footwear of claim 3, wherein the support cage includes a forward edge fixedly and immovably joined with the toe section, and a rearward edge fixedly and immovably joined with the heel section.

5. An article of footwear comprising:

an upper comprising:

a midfoot section including a sleeve configured to extend from a medial side of the footwear, across the top of a wearer's forefoot, to a lateral side of the footwear;

a toe section joined with and forward of the midfoot section, the toe section including a breathable material;

a heel section joined with and rearward of the midfoot section;

a support cage having a forward edge and constructed from a plurality of layers to form a laminate, the laminate including a structural exterior layer, an intermediate elastic layer and a reinforcement interior layer joined with one another, an outsole joined with the upper, wherein the support cage is free floating relative to the midfoot section, wherein the forward edge of the support cage is stitched to the toe section with stitching so that the support cage is not free floating relative to the toe section, whereby the footwear can accommodate a plurality of foot shapes regardless of whether the foot shapes remain static or dynamically change during a gait cycle, wherein the toe section is separately constructed from the midfoot section and joined with the midfoot section adjacent a rearward edge of the toe section, the rearward edge extending downward toward the outsole on at least one of the lateral side and the medial side of the footwear.

6. The article of footwear of claim 5, wherein the heel section includes a heel support frame configured to extend around at least a portion of a wearer's heel, wherein the heel support frame is disposed adjacent a heel band extending from the support cage.

7. The article of footwear of claim 5 wherein the support cage is fixedly and immovably joined with the toe section and fixedly and immovably joined with the heel section, while remaining free floating relative to the sleeve.

8. The article of footwear of claim 5 wherein the exterior layer is a polymeric film, the intermediate layer is an elastic and the interior layer is a reinforcement, and the exterior, intermediate, and interior layers are fused together to form the laminate.

9. An article of footwear comprising:

a longitudinal axis;

a lateral side disposed opposite a medial side across the longitudinal axis;

a sole assembly including a heel region, an arch region and a forefoot region; and an upper assembly joined with the sole assembly, the upper assembly comprising:

a midfoot section joined with the sole assembly in the arch region, the midfoot section including a lateral panel disposed on the lateral side of the footwear, a medial panel disposed on the medial side of the footwear, and a central panel configured to span across the top of a wearer's forefoot, joining the lateral panel and the medial panel to form a continuous sleeve adapted to extend at least partially around a wearer's foot;

a heel section including a heel support frame constructed from a rigid polymeric material, the heel support frame adapted to extend rearward and around a wearer's heel adjacent the heel region of the sole assembly;

a support cage constructed from a laminate, the laminate including a polymeric film exterior layer and a reinforcement interior layer, with an elastic intermediate layer disposed between the interior layer and the exterior layer, the polymeric film exterior layer, elastic intermediate layer and reinforcement interior layer being fused together to form the laminate, the support cage including a plurality of upright elements extending upwardly away from the sole assembly, wherein the plurality of upright elements are separated from one another with at least one open space so that at least a portion of a first upright element moves independently of another portion of a second upright element, wherein the support cage extends upwardly adjacent the lateral panel and the medial panel without crossing over the central panel of the midfoot section, wherein the support cage includes a rearward edge stitched to the heel section, wherein the support cage is free floating relative to the midfoot section so that an interior of the support cage can engage but moves relative to the medial panel and the lateral panel, whereby the footwear can accommodate a plurality of foot shapes therein.

10. The article of footwear of claim 9, wherein the first upright element and the second upright element are disposed on the lateral side;

wherein the first upright element and the second upright element include a first lace attachment element and a second lace attachment element, respectively, wherein a lace is joined with the first lace attachment element of the first upright element and extends across the central panel of the midfoot section, wherein the lace is joined with a third lace attachment element of a third upright element disposed on the medial side;

wherein the lace extends back across the central panel, and is joined with the second lace attachment element of the second upright element disposed on the lateral side.

11. The article of footwear of claim 9 comprising a toe section joined with the sole assembly in the forefoot region, wherein the toe section is constructed from a breathable material, wherein the support cage is joined with and fixedly attached to the toe section.

12. The article of footwear of claim 11, wherein the support cage includes a forward edge, wherein the forward edge is stitched to the toe section, wherein the forward edge of the support cage extends down to the outsole.

13. The article of footwear of claim 12, wherein the support cage includes a heel band that extends configured to extend around at least a portion of the wearer's heel, wherein the heel band being stitched to the heel section.

14. The article of footwear of claim 9 comprising a toe section forward of the midfoot section, wherein a forward edge of the support cage is immovably stitched to a rearward edge of the toe section and the rearward edge of the support cage is immovably stitched to a forward edge of the heel section, while remaining free floating relative to the midfoot section.

15. The article of footwear of claim 9 wherein the at least one open space is adapted to enable the first upright element to move at least one of toward and away from the second upright element during a gait cycle of the wearer, whereby the support cage dynamically moves relative to the sleeve.

16. The article of footwear of claim 1, wherein the midfoot section includes a second lower peripheral allowance, wherein the first and second lower peripheral allowances are stitched with stitching to the insole board, wherein the first and second lower peripheral allowances lie adjacent one another.

17. The article of footwear of claim 5, wherein the support cage includes a first lower peripheral allowance, wherein the first lower peripheral allowance is joined with a separately constructed insole board, wherein the insole board closes a bottom of the support cage.

18. The article of footwear of claim 17, wherein the midfoot section includes a second lower peripheral allowance, wherein the second lower peripheral allowance is joined with the insole board, wherein the insole board closes a bottom of the midfoot section.

19. The article of footwear of claim 18, wherein the first and second lower peripheral allowances are stitched with stitching to the insole board, wherein the first and second lower peripheral allowances lie adjacent one another.

20. The article of footwear of claim 1, wherein the lateral and medial panels are stitched to the first lower peripheral allowance and to the insole board.

* * * * *